US009290350B2

(12) United States Patent
Makida et al.

(10) Patent No.: US 9,290,350 B2
(45) Date of Patent: Mar. 22, 2016

(54) TRANSPORT DEVICE

(71) Applicant: FUJI XEROX CO., LTD., Tokyo (JP)

(72) Inventors: Seigo Makida, Kanagawa (JP); Takao Furuya, Kanagawa (JP); Yoshinari Iwaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/267,200

(22) Filed: May 1, 2014

(65) Prior Publication Data

US 2015/0097014 A1 Apr. 9, 2015

(30) Foreign Application Priority Data

Oct. 4, 2013 (JP) ..... 2013-208975

(51) Int. Cl.
*B65H 20/02* (2006.01)
*B65H 23/26* (2006.01)

(52) U.S. Cl.
CPC ..... *B65H 20/02* (2013.01); *B65H 23/26* (2013.01); *B65H 2404/61* (2013.01); *B65H 2515/842* (2013.01); *B65H 2553/42* (2013.01); *B65H 2801/03* (2013.01)

(58) Field of Classification Search
CPC .. B65H 20/02; B65H 23/26; B65H 2515/842; B65H 2404/61; B65H 2553/42; B65H 2801/03; G03G 15/6576; G03G 2215/00662; G03G 15/235
USPC ..... 399/406
See application file for complete search history.

(56) References Cited

U.S. PATENT DOCUMENTS

| | | | | |
|---|---|---|---|---|
| 5,519,477 | A * | 5/1996 | Bell et al. | 399/307 |
| 5,947,467 | A * | 9/1999 | Billings et al. | 271/188 |
| 6,112,048 | A * | 8/2000 | Westhoff | 399/406 |
| 6,698,752 | B1 * | 3/2004 | Kakuta et al. | 271/188 |
| 7,758,044 | B2 * | 7/2010 | Nonaka | 271/274 |
| 8,047,538 | B2 * | 11/2011 | Katsura et al. | 271/242 |
| 8,301,074 | B2 * | 10/2012 | Kawachi et al. | 399/406 |
| 8,608,164 | B2 * | 12/2013 | Takai et al. | 271/265.02 |
| 2009/0268007 | A1 * | 10/2009 | Sekino et al. | 347/218 |
| 2010/0278572 | A1 * | 11/2010 | Nakajima et al. | 399/381 |
| 2012/0128397 | A1 * | 5/2012 | Chang | 399/406 |
| 2012/0148322 | A1 * | 6/2012 | De Jong | 399/406 |
| 2013/0014624 | A1 * | 1/2013 | Eoka et al. | 83/156 |

FOREIGN PATENT DOCUMENTS

| | | | | |
|---|---|---|---|---|
| JP | 09202519 A | * | 8/1997 | B65H 43/04 |
| JP | A-2005-208004 | | 8/2005 | |

* cited by examiner

*Primary Examiner* — Jeremy R Severson
(74) *Attorney, Agent, or Firm* — Oliff PLC

(57) ABSTRACT

Provided is a transport device including a first transport member that transports a sheet-shaped medium in a transport direction, a transport path that is formed by a first guiding member which guides the medium in the transport direction and a second guiding member which guides the medium in the transport direction, at least one of the first guiding member and the second guiding member including a widened part on a downstream side of a processing position and on an upstream side of a second transport member, a pressing member that presses the medium to the first guiding member, a processing unit that performs a processing on the medium which is transported in the transport path, and a second transport member that transports the medium, which is guided by the first guiding member and the second guiding member, in the transport direction.

20 Claims, 7 Drawing Sheets

TRANSPORT DEVICE

CROSS-REFERENCE TO RELATED APPLICATIONS

This application is based on and claims priority under 35 USC 119 from Japanese Patent Application No. 2013-208975 filed Oct. 4, 2013.

BACKGROUND

Technical Field

The present invention relates to a transport device.

SUMMARY

According to an aspect of the invention, there is provided a transport device including:

a first transport member that transports a sheet-shaped medium in a transport direction;

a transport path that is formed by a first guiding member which is disposed on a downstream side of the first transport member in the transport direction and on a first surface side of the transported medium to guide the medium in the transport direction and a second guiding member which is disposed on a second surface side of the transported medium which is on a back side of the first surface to guide the medium in the transport direction, at least one of the first guiding member and the second guiding member including a widened part on a downstream side of a processing position and on an upstream side of a second transport member;

a pressing member that presses the medium to the first guiding member;

a processing unit that performs a processing on the medium which is transported in the transport path on a further downstream side in the transport direction than the pressing member; and a second transport member that is disposed on the downstream side of the processing position where the processing unit performs the processing on the medium, and transports the medium, which is guided by the first guiding member and the second guiding member, in the transport direction.

BRIEF DESCRIPTION OF THE DRAWINGS

Exemplary embodiments of the present invention will be described in detail based on the following figures, wherein.

DETAILED DESCRIPTION

[1] First Exemplary Embodiment

[1-1] Configuration

Figure 1A:
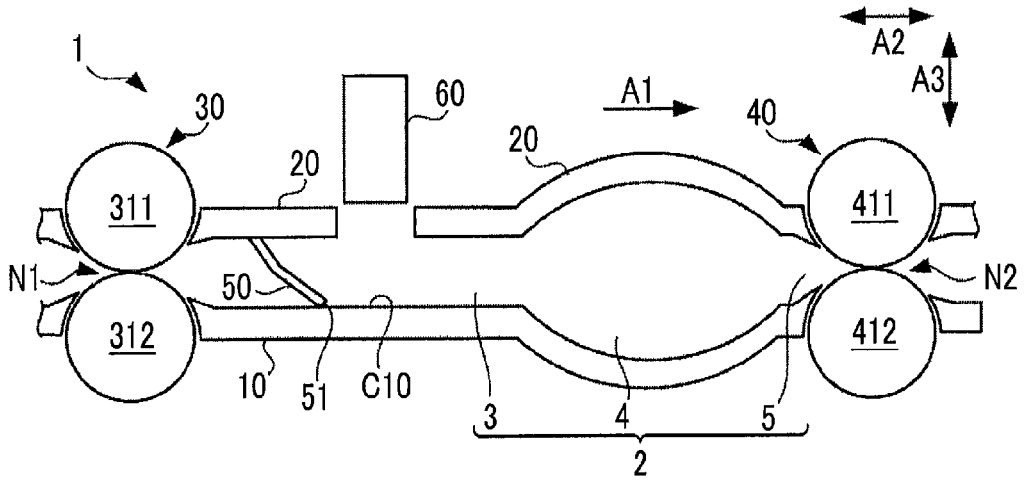
FIGS. 1A and 1B are views illustrating an example of a configuration of a transport device according to a first exemplary embodiment.
Figure 1B:
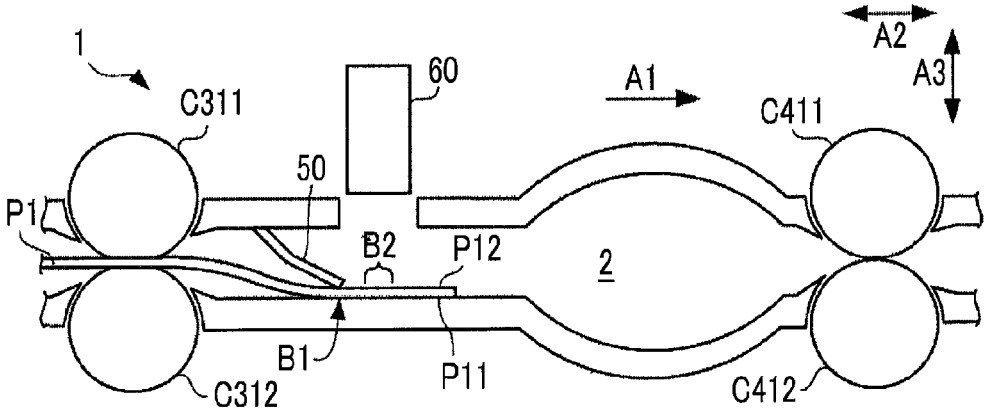

FIGS. 1A and 1B are views illustrating an example of a configuration of a transport device according to a first exemplary embodiment. In this example, a transport device 1 includes a first guiding member 10, a second guiding member 20, a first transport member 30, a second transport member 40, a pressing member 50, and a reading device 60. Only the transport device 1 is illustrated in FIG. 1A, and FIG. 1B illustrates how the transport device 1 transports a medium P1 where an image is formed by an image forming unit (not illustrated). Hereinafter, each unit will be described with reference to both FIGS. 1A and 1B. A transport path 2 is a path where a sheet-shaped medium (for example, the medium P1) is transported. The medium is transported in a transport direction A1 in the transport path 2. In this exemplary embodiment, the transport direction A1 is along a horizontal direction A2.

The first transport member 30 is an example of means for transporting the medium in the transport direction A1. The first transport member 30 includes a rotating member that rotates about an axis, and transports the medium that comes into contact with an outer surface of the rotating member by rotating the rotating member. In the example of FIGS. 1A and 1B, the medium P1 that comes into contact with outer surfaces C311 and C312 (hereinafter, referred to as an "outer surface C310" when not particularly distinguished) of rotating members 311 and 312 (hereinafter, referred to as a "rotating member 310" when not particularly distinguished) is transported. The first transport member 30 may be configured to transport the medium by using a belt. Hereinafter, an area where the outer surface C310 comes into contact with the medium is referred to as a nip area N1.

The first guiding member 10, which is disposed on the downstream side of the first transport member 30 in the transport direction A1 and on a first surface side of the medium that is transported, is an example of a member that guides the medium in the transport direction A1. In the example of FIGS. 1A and 1B, the first guiding member 10 is disposed on a first surface P11 side of the medium P1. The second guiding member 20, which is disposed on a second surface side that is a back side of the first surface of the transported medium, is an example of a member that guides the medium in the transport direction A1. The second guiding member 20 forms the transport path 2 for the medium with the first guiding member 10. In this exemplary embodiment, the first surface P11 is a surface toward a lower side of the medium P1 in a vertical direction A3, and a second surface P12 is a surface toward an upper side of the medium P1 in the vertical direction A3.

The pressing member 50 is an example of a member that presses the medium to the first guiding member 10. The pressing member 50 is a member that for example, contains a resin and is formed into a plate shape. In the example of FIG.

1B, one side of the pressing member 50 is fixed to the second guiding member 20, and an end portion 51 on the opposite side presses the medium P1 to the first guiding member 10. Hereinafter, a position where the medium is pressed to the first guiding member 10 by the pressing member 50, that is, a position where the end portion 51 comes into contact with the medium is referred to as a "pressing position." FIGS. 1A and 1B illustrate a pressing position B1. The reading device 60 is an example of means for performing processing on the medium, which is transported in the transport path 2, on the further downstream side than the pressing member 50 in the transport direction A1. For example, the reading device 60 reads an image that is formed at a part at a position of the second surface P12 of the medium P1 which faces the subject device. Hereinafter, a position where the processing is performed on the medium by the reading device 60, that is, a position where the processing (image reading in this exemplary embodiment) is performed on the medium that is transported in the transport path 2 is referred to as a "processing position." FIG. 1B illustrates a processing position B2. The reading device 60 outputs image data, which shows the image that is read, to an information processing apparatus (not illustrated) and the like.

The second transport member 40, which is disposed on the downstream side of the processing position B2, is an example of means for transporting the medium that is guided by the first guiding member 10 and the second guiding member 20 in the transport direction A1. The second transport member 40 includes a rotating member that rotates about an axis, and transports the medium that comes into contact with an outer surface of the rotating member by rotating the rotating member. The second transport member 40, as is the case with the first transport member 30, may be configured to transport the medium by using a belt. In the example of FIGS. 1A and 1B, the medium P1 that comes into contact with outer surfaces C411 and C412 (hereinafter, referred to as an "outer surface C410" when not particularly distinguished) of rotating members 411 and 412 (hereinafter, referred to as a "rotating member 410" when not particularly distinguished) is transported. Hereinafter, an area where the outer surface C410 comes into contact with the medium is referred to as a nip area N2. In this exemplary embodiment, the second transport member 40 rotates the rotating member 410 such that a moving speed (hereinafter, referred to as an "outer surface speed") of the outer surface C410 of the rotating member 410 is slower than the outer surface speed of the first transport member 30. In this manner, a speed at which the second transport member 40 transports the medium P1 (hereinafter, referred to as a "second transport speed") is slower than a speed at which the first transport member 30 transports the medium P1 (hereinafter, referred to as a "first transport speed"). Hereinafter, the outer surface speed of the first transport member is referred to as a "first outer surface speed," and the outer surface speed of the second transport member is referred to as a "second outer surface speed."

In the transport path 2, a space (hereinafter, referred to as an "expansion space") 4 that is widened to a first guiding member 10 side and a second guiding member 20 side is formed on the downstream side of the processing position B2 in the transport direction A1 and on the upstream side of the second transport member 40 in the transport direction A1. In addition, in the transport path 2, a processing space 3, where the processing (image reading by the reading device 60 in this exemplary embodiment) is performed by a processing unit, is formed on the upstream side of the expansion space 4 in the transport direction A1 and on the downstream side of the first transport member 30 in the transport direction A1. The processing position B2 is included in the processing space 3. In the processing space 3, a surface C10 of the first guiding member 10 that faces the medium is flat, particularly at a part including the processing position B2, except for an end portion on a first transport member 30 side. In this manner, a distance between the reading device 60 and the medium is more likely to be maintained to be constant when the medium is transported in close contact with the first guiding member 10 at the processing position B2 than when the medium is transported not in close contact with the first guiding member 10 but apart from the first guiding member 10. In other words, a posture of the medium at the processing position B2 is likely to be stabilized. In addition, in the transport path 2, a guiding space 5 is formed on the downstream side of the expansion space 4 in the transport direction A1 and the upstream side of the second transport member 40 in the transport direction A1 so as to guide the medium to the nip area N2 of the second transport member 40.

[1-2] Overview

In this exemplary embodiment, the second outer surface speed is slower than the first outer surface speed and the second transport speed is slower than the first transport speed as described above. Accordingly, a slack occurs in the medium that is transported in the transport path 2.

Figure 2:
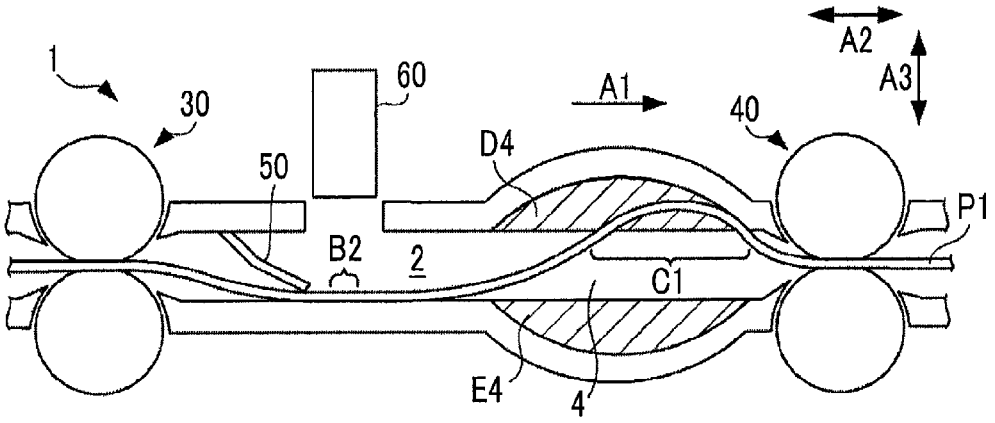
FIG. 2 is a view illustrating an example of how a slack occurs in a medium in a transport path.

FIG. 2 is a view illustrating an example of how the slack occurs in the medium in the transport path 2. In this example, a slack part C1 of the medium P1, where the slack occurs, is transported through a widening part D4 (hatched part in the drawing) of the expansion space 4 which is widened to the second guiding member 20 side. The medium P1 is transported while being in close contact with the first guiding member 10 at the processing position B2 where the image is read by the reading device 60. When the expansion space 4 is not formed in the transport path, the medium P1 is more likely to be transported apart from the first guiding member 10 than when the expansion space 4 is formed in the transport path. A reason therefor will be described with reference to FIG. 3.

Figure 3:
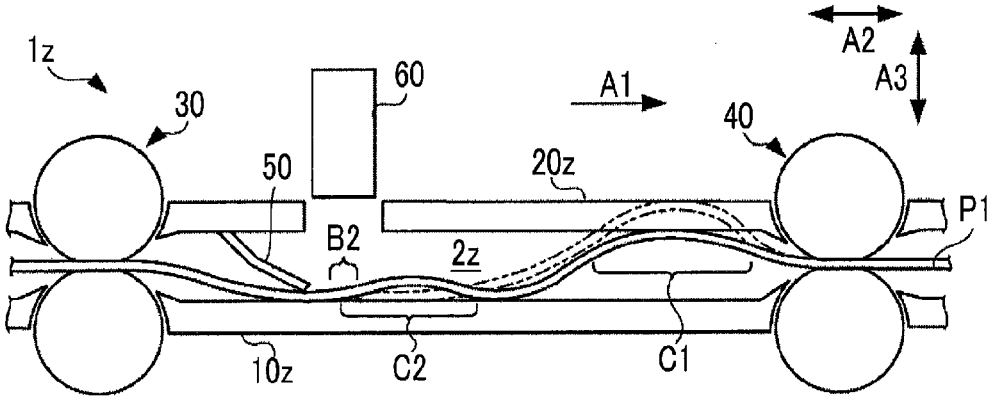
FIG. 3 is a view illustrating an example of the transport device where an expansion space is not formed in the transport path.

FIG. 3 is a view illustrating an example of the transport device where the expansion space is not formed in the transport path. In this example, a distance between a first guiding member 10*z* and a second guiding member 20*z* is constant on the downstream side of the processing position B2 in the transport direction A1. When the slack illustrated in FIG. 2 occurs in the medium P1, the widening part D4 is not present in a transport path 2*z* formed by these guiding members, and thus the slack part C1 comes into contact with the second guiding member 20*z* and is pressed back to a first guiding member 10*z* side. In FIG. 3, a state of the medium P1 illustrated in FIG. 2 is illustrated with a two-dot chain line. In the medium P1, the slack occurs not sufficiently on a second guiding member 20*z* side, and the slack occurs in the other places. In the example of FIG. 3, a slack part C2 is generated on the further downstream side in the transport direction A1 than a position where the medium P1 is pressed by the pressing member 50 to the first guiding member 10*z*, and the slack part C2 occurs across the processing position B2. In other words, at the processing position B2, the medium P1 is transported in a state of being separated from the first guiding member 10*z*.

When compared to the example of FIG. 3, in which the medium P1 is transported apart from the first guiding member 10, the distance between the reading device 60 and the medium is likely to be maintained to be constant in the example of FIG. 2 in which the medium P1 is transported in close contact with the first guiding member 10 at the processing position B2. In other words, according to this exemplary embodiment, the posture of the medium at the processing position B2 is more stabilized than when the expansion space is not formed in the transport path and, for example, the cross-sectional area of any place in the transport path is constant. As a result, processing accuracy (accuracy of image reading in this exemplary embodiment) is also improved. This is similar to when the medium is transported through a widening part E4 (hatched part in the drawing) of the expansion space 4 that is widened to the first guiding member 10 side.

In addition, in this exemplary embodiment, the slack occurs in the medium since the second outer surface speed is slower than the first outer surface speed and the second transport speed is slower than the first transport speed. However, when this difference in speed is opposite, the slack does not occur but a part of the medium that is pressed to the first guiding member 10 by the pressing member 50 is separated from the first guiding member 10.

Figure 4:
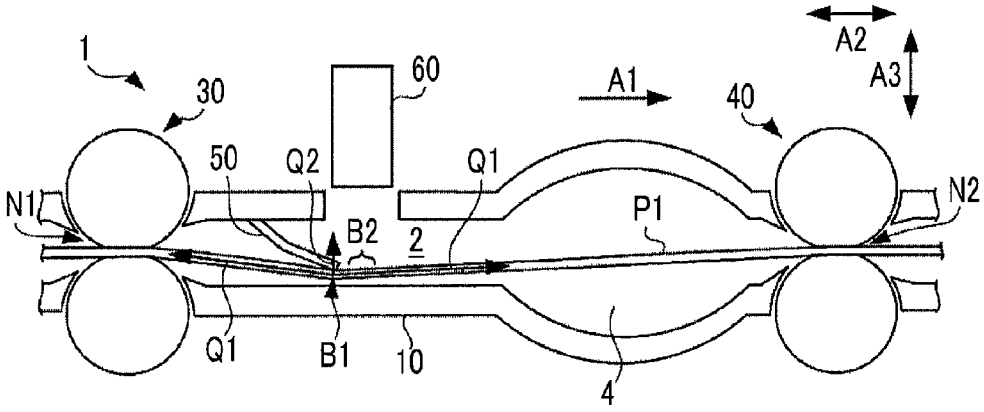
FIG. 4 is a view illustrating an example of how the medium is separated from a first guiding member and transported.

FIG. 4 is a view illustrating an example of how the medium is separated from the first guiding member 10 and transported. As described above, the pressing member 50 is formed to contain the resin or the like, and thus is deformed when a force is applied.

For example, when the second outer surface speed is faster than the first outer surface speed, a pulling force (hereinafter, referred to as a "tensile force") Q1 acts on the medium on nip area N1 and N2 sides, and an upward component force Q2 of the tensile force Q1 in the vertical direction A3 is added to the end portion 51 of the pressing member 50 at the pressing position B1. When the pressing member 50 is deformed by the component force Q2, the medium is transported in a state of being separated from the first guiding member 10 as illustrated in FIG. 4. As a result, the medium is transported in a state of being separated from the first guiding member at the processing position B2 as well, and the distance between the reading device 60 and the medium is not maintained to be constant. In this exemplary embodiment, the rotating members of the first and second transport members are respectively rotated at the outer surface speeds described above, and the pulling force is not added to the medium. In this manner, the medium is less likely to be separated from the first guiding member than when the rotating members are not rotated at the above-described outer surface speeds (in other words, when the second outer surface speed is not slower than the first outer surface speed), that is, when the respective transport members do not transport the medium at the above-described transport speeds (in other words, when the second transport speed is not slower than the first transport speed).

[2] Second Exemplary Embodiment

Hereinafter, a second exemplary embodiment of the invention will be described, focusing on differences between the first exemplary embodiment and the second exemplary embodiment.

Figure 5:
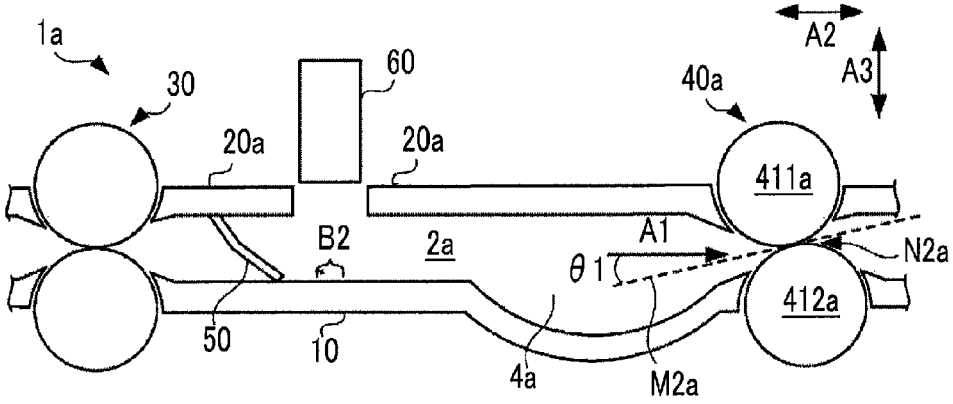
FIG. 5 is a view illustrating an example of a configuration of a transport device according to a second exemplary embodiment.

FIG. 5 is a view illustrating an example of a configuration of a transport device according to the second exemplary embodiment. FIG. 5 illustrates a transport device la including the first guiding member 10, a second guiding member 20*a*, the first transport member 30, a second transport member 40*a*, the pressing member 50, and the reading device 60. The first guiding member 10 and the second guiding member 20*a* form a transport path 2*a*, and an expansion space 4*a* is formed in the transport path 2*a*.

The expansion space 4*a* is widened to the first guiding member 10 side, but is not widened to a second guiding member 20*a* side. In other words, the expansion space 4*a* is wider on the first guiding member 10 side than on the second guiding member 20*a* side. In other words, the second guiding member 20*a* side is narrower than the first guiding member 10 side. In this manner, a space of the transport device that is occupied by the second guiding member side of the transport path is smaller than when the second guiding member side is not narrower than the first guiding member side, and thus installation of another device is likely to be facilitated and the transport path is likely to be arranged in a freer manner.

In addition, the second transport member 40*a* includes rotating members 411*a* and 412*a* (hereinafter, referred to as "rotating members 410*a*" when not particularly distinguished), and is arranged to be inclined with respect to the transport direction A1. More specifically, each of the rotating members 410*a* forms a nip area N2*a*, and a tangent M2*a* of the rotating members 410*a* in the nip area N2*a* is inclined at an angle θ1 with respect to the transport direction A1. The second transport member 40*a* is disposed in this manner, and thus transports the medium, which is guided by the first and second guiding members, such that the downstream side of the medium in the transport direction A1 is directed toward the first guiding member 10 side. Since the second transport member 40*a* transports the medium in this manner, the medium that is transported through the expansion space 4*a* is more likely to pass through the first guiding member 10 side than the second guiding member 20*a* side.

In addition, in this exemplary embodiment, the medium is likely to pass through the first guiding member 10 side in this manner although the second guiding member 20*a* side is narrower than the first guiding member 10 side as described above. As such, compared to when the second guiding member does not transport the medium in the manner described in this exemplary embodiment, a bending part of the medium is pressed back by the second guiding member 20*a* and a bending part is less likely to be generated at the processing position B2 as described in the example of FIG. 3.

[3] Third Exemplary Embodiment

Hereinafter, a third exemplary embodiment of the invention will be described, focusing on differences from the first and second exemplary embodiments.

Figure 6A:
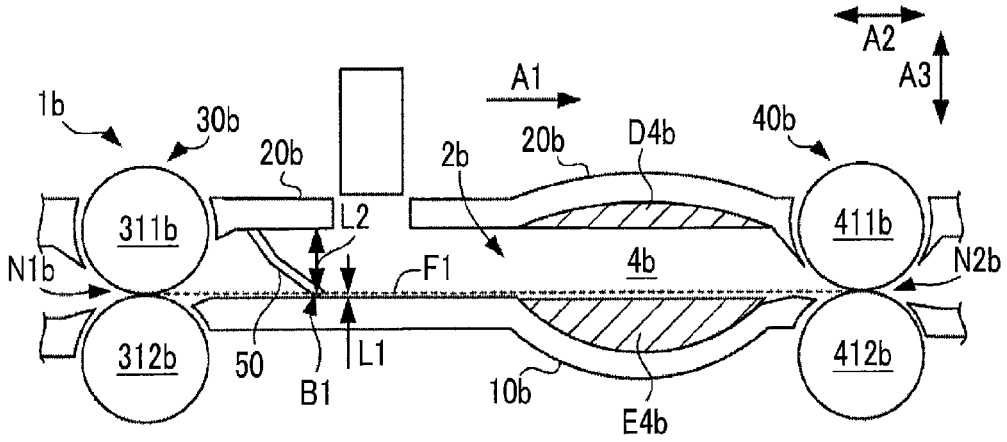
FIGS. 6A and 6B are views illustrating an example of a configuration of a transport device according to a third exemplary embodiment.
Figure 6B:
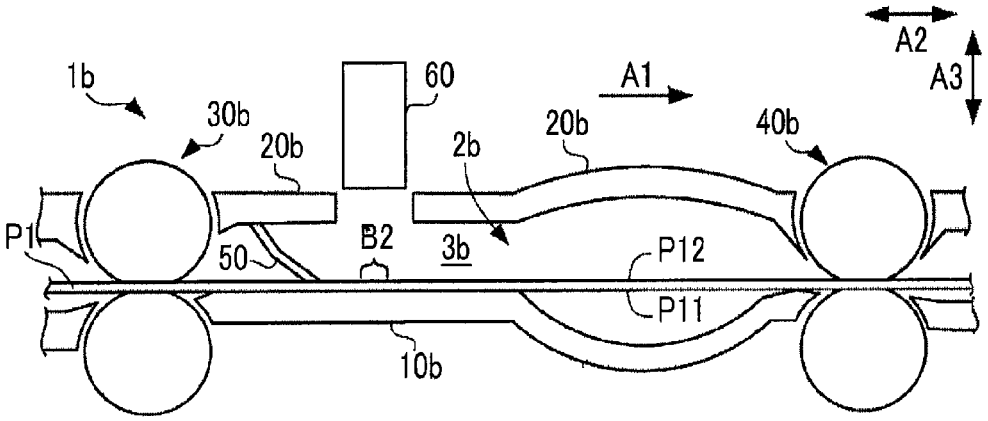

FIGS. 6A and 6B are views illustrating an example of a configuration of a transport device according to a third exemplary embodiment. FIGS. 6A and 6B illustrate a transport device 1*b* including a first guiding member 10*b*, a second guiding member 20*b*, a first transport member 30*b*, a second transport member 40*b*, the pressing member 50, and the reading device 60. The first guiding member 10*b* and the second guiding member 20*b* form a transport path 2*b* that is provided with a processing space 3*b* and an expansion space 4*b*. FIG. 6A illustrates only the transport device 1*b*, and FIG. 6B illustrates how the transport device 1*b* transports the medium P1.

The first transport member 30*b* includes rotating members 311*b* and 312*b* (hereinafter, referred to as "rotating members 310*b*" when not particularly distinguished), and each of the rotating members 310*b* forms a nip area N1*b*. The nip area N1*b* represents a position where the first transport member 30*b* comes into contact with the medium, and will be referred to as a "first position" hereinafter. The second transport member 40*b* includes rotating members 411*b* and 412*b* (hereinafter, referred to as "rotating members 410*b*" when not particularly distinguished), and each of the rotating members 410*b* forms a nip area N2*b*. The nip area N2*b* represents a position where the second transport member 40*b* comes into contact with the medium, and will be referred to as a "second position" hereinafter. A line segment F1 that connects the first position and the second position with each other is illustrated in FIG. 6A.

In this exemplary embodiment, a distance (hereinafter, referred to as a "first distance") L1 between the line segment F1 and the first guiding member 10*b* at the pressing position B1 is shorter than a distance (hereinafter, referred to as a "second distance") L2 between the line segment F1 and the second guiding member 20*b* at the pressing position B1. More specifically, the first transport member 30*b* and the second transport member 40*b* are arranged such that the first surface P11 of the medium P1 in a state of being present along the transport direction A1 comes into close contact with the first guiding member 10*b* in the processing space 3*b*. In other words, the first distance L1 is equal to half of the thickness of the medium P1. In this manner, the medium P1 is not separated from the first guiding member 10*b* at the processing position B2 even when a pulling force is added to the medium P1 on nip area N1*b* and N2*b* sides, and the distance between the medium P1 and the reading device 60 is maintained to be constant.

In addition, in this exemplary embodiment, a widening part D4*b* of the expansion space 4*b* that is widened to a second guiding member 20*b* side is smaller than a widening part E4*b* that is widened to a first guiding member 10*b* side. In other words, the expansion space 4*b* is wider on the first guiding member 10*b* side than on the second guiding member 20*b* side. In this manner, a space of the transport device that is occupied by the second guiding member side of the transport path is smaller than when the second guiding member side is not narrower than the first guiding member side as is the case with the second exemplary embodiment. In addition, the medium is transported through a position farther from the second guiding member 20*b* than from the first guiding member 10*b* even when the second guiding member side is narrowed, and the medium in which a deflection occurs is less likely to be pressed back in contact with the second guiding member 20*b* than when the first distance L1 is not shorter than the second distance L2.

The first and second positions described above may be further toward the second guiding member side than the position illustrated in FIGS. 6A and 6B insofar as the first distance is shorter than the second distance. In this case, the upward component force is added to the pressing member 50 at the pressing position B1 when the tensile force mentioned in the description of FIG. 4 is added to the medium. However, an angle that is formed by two directions in which the tensile force is added becomes closer to 180 degrees than when the first distance and the second distance are equal to each other, and thus the upward component force is decreased. In this manner, the medium to which the tensile force is added is less likely to be separated from the first guiding member than when the first distance is not shorter than the second distance.

[4] Modification Example

Each of the exemplary embodiments described above is only an example of the invention, and may be modified as follows. In addition, the respective exemplary embodiments described above and the respective following modification examples may be combined with each other if necessary.

[4-1] Second Pressing Member

Plural pressing members may be disposed.

Figure 7:
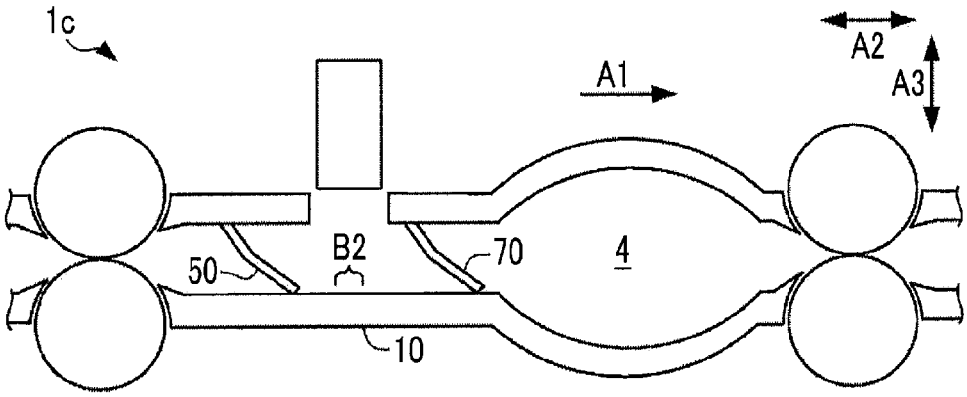
FIG. 7 is a view illustrating an example of a configuration of a transport device according to a modification example.

FIG. 7 is a view illustrating an example of a configuration of a transport device according to this modification example. In this example, a transport device is that includes a second pressing member 70 in addition to each of the members illustrated in FIGS. 1A and 1B is illustrated. The second pressing member 70 is disposed on the downstream side of the processing position B2 in the transport direction A1 and on the upstream side of the expansion space 4 in the transport direction A1, and is an example of a member that presses the first surface of the medium to the first guiding member 10. The medium is pressed to the first guiding member 10 also on the downstream side of the processing position B2 by the second pressing member 70, and thus the medium is less likely to be in a state of being separated from the first guiding member 10 at the processing position B2 than when the second pressing member is not disposed. In other words, the posture of the medium is more stabilized at the processing position B2 than when the transport device does not include the second pressing member and includes only one pressing member.

[4-2] Expansion Space I

In each of the exemplary embodiments described above, the expansion space is not connected to a space (hereinafter, referred to as an "external space") out of the transport path on a vertical direction A3 side. However, the expansion space may be connected to the external space.

Figure 8:
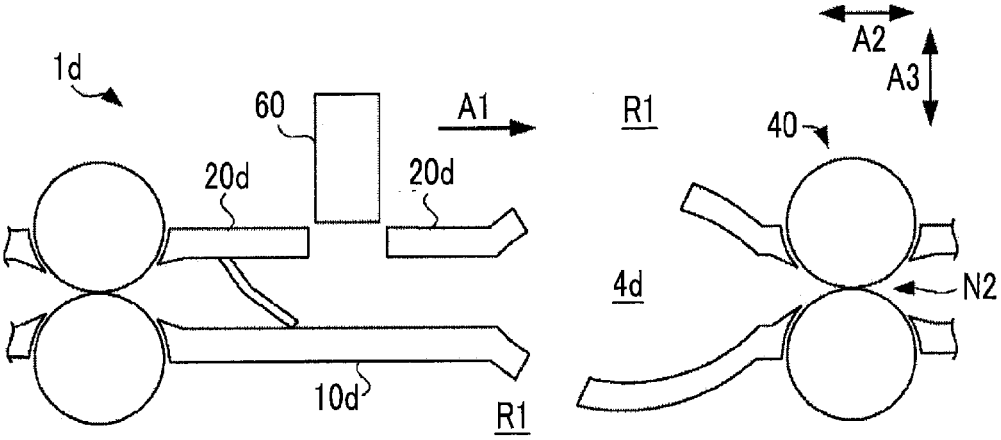
FIG. 8 is a view illustrating an example of another configuration of the transport device according to a modification example.

FIG. 8 is a view illustrating an example of the configuration of the transport device according to this modification example. This example illustrates a transport device 1*d* that includes a first guiding member 10*d* and a second guiding member 20*d* which form an expansion space 4*d* connected to an external space R1 in the vertical direction A3. Herein, the expansion space 4*d* is formed because the first guiding member 10*d* and the second guiding member 20*d* include opening portions respectively on the downstream side of the reading device 60 and the upstream side of the second transport member 40. Even in this case, the medium that is transported may be guided to the nip area N2 of the second transport member 40 by the first guiding member 10*d* and the second guiding member 20*d*. In other words, the first guiding member 10*d* and the second guiding member 20*d* are arranged at positions that may be reached by a tip end of the transported medium on the downstream side of the expansion space 4*d* in the transport direction A1, and are formed such that the tip end is guided to the nip area N2.

[4-3] Expansion Space II

The widening part of the expansion space that is widened to the first guiding member side and the second guiding member side has a rounded shape in each of the exemplary embodiments described above. However, the widening part maybe configured to have a flat surface shape.

Figure 9:
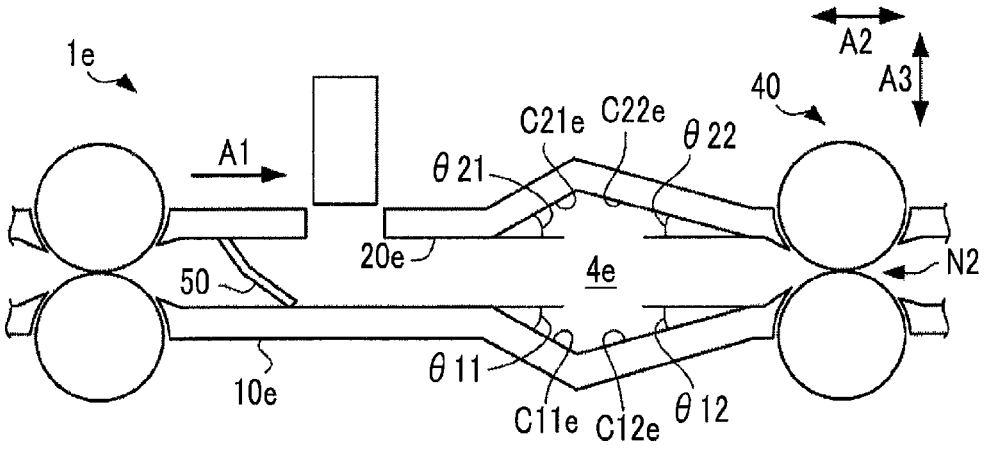
FIG. 9 is a view illustrating an example of another configuration of the transport device according to a modification example.

FIG. 9 is a view illustrating an example of the configuration of the transport device according to this modification example. This example illustrates a transport device le that includes a first guiding member 10*e* which has a first surface C11*e* and a second surface C12*e*, both of which are flat and form an expansion space 4*e*, and a second guiding member 20*e* which has a first surface C21*e* and a second surface C22*e*, both of which are flat and form the expansion space 4*e*. The first surface C11*e* and the first surface C21*e* are arranged on the upstream side in the transport direction A1.

The first surface C11*e* and the transport direction A1 form a first angle θ11, and the first surface C21*e* and the transport direction A1 form a first angle θ21. Herein, the angle that is formed by the surface and the direction refers to an angle formed by a line segment in the direction and the surface, and refers to an angle XZY when an end point of the line segment is assumed to be X, an intersection between a perpendicular line from the endpoint X to the surface and the surface is assumed to be Y, and an intersection between the line segment and the surface is assumed to be Z. The second surfaces C12*e* and C22*e* are respectively arranged on a further downstream side in the transport direction A1 than the first surfaces C11*e* and C21*e*. The second surface C12*e* and the transport direction A1 form a second angle θ12, and the second surface C22*e* and the transport direction A1 form a second angle θ22. The first angle θ11 is larger than the second angle θ12, and the first angle θ21 is larger than the second angle θ22.

According to this modification example, the second angle that is arranged on the downstream side is smaller than the first angle that is arranged on the upstream side, and thus the tip end of the transported medium is more likely to collide with the guiding member at a gentle angle and a tip end side of the medium is more likely to be guided toward the nip area N2 of the second transport member 40 without being bent than when the first and second angles do not have this relationship.

Both the first and second guiding members have the first and second surfaces in the example of FIG. 9, but the invention is not limited thereto and only one of both of the guiding members may have the first and second surfaces. In addition, the first angles θ11 and θ21 are common and the second angles θ12 and θ22 are common in the example of FIG. 9, but these angles may be different from each other. Furthermore, the first surface C11*e* and the second surface C12*e*, and the first surface C21*e* and the second surface C22*e* are respectively connected in a linear manner in the example of FIG. 9, but connection parts of the respective surfaces may be curved surfaces.

[4-4] Expansion Space III

In the first exemplary embodiment, the expansion space has the widening parts on both the first guiding member side and the second guiding member side. However, as in the example described in the second exemplary embodiment, the expansion space may have the widening part on only one of the first guiding member side and the second guiding member side.

Figure 10:
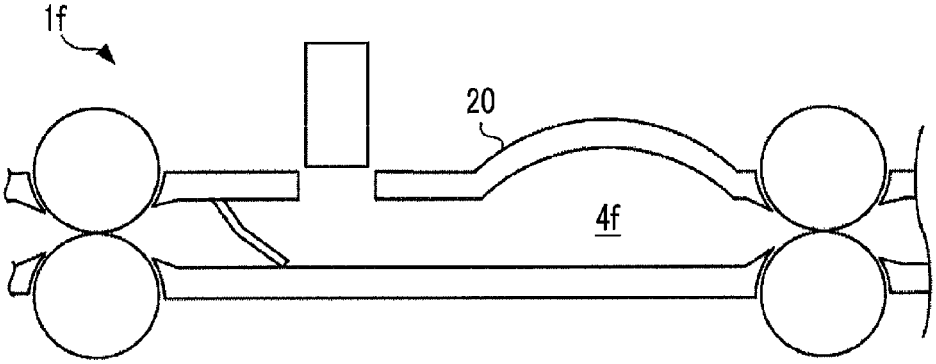
FIG. 10 is a view illustrating an example of another configuration of the transport device according to a modification example.

FIG. 10 is a view illustrating an example of the configuration of the transport device according to this modification example. This example illustrates a transport device if in which an expansion space 4*f*, which has a widening part only on the second guiding member 20 side, is formed. Even in this case, the slack part of the transported medium is transported through the widening part on the second guiding member 20 side, and thus the posture of the medium is more stabilized at the processing position B2 than when the expansion space is not formed in the transport path and, for example, the cross-sectional area of any place in the transport path is constant. In this manner, in the transport path, the expansion space which is widened to at least one of the first and second guiding members may be formed on the downstream side of the processing position and the upstream side of the second transport member.

[4-5] Processing Performed by Processing Unit

The transport device includes the reading device 60 as the processing unit in each of the exemplary embodiments described above. However, the processing unit is not limited thereto. For example, the transport device may include an ejecting device that ejects ink to the medium as the processing unit, and may function as an image forming apparatus that forms an image by an inkjet method. In other words, the processing unit may perform any processing on the transported medium.

[4-6] Direction of Transport Direction

The transport direction is along the horizontal direction A2 in each of the exemplary embodiments described above. However, the transport direction is not limited thereto and, for example, may be along the vertical direction A3 and may be along directions (diagonal directions) crossing these directions. In other words, the transport path may transport the medium in any direction.

[4-7] Arc-drawing Transport Direction

The transport path may transport the medium in an arc-drawing (curved) transport direction.

Figure 11:
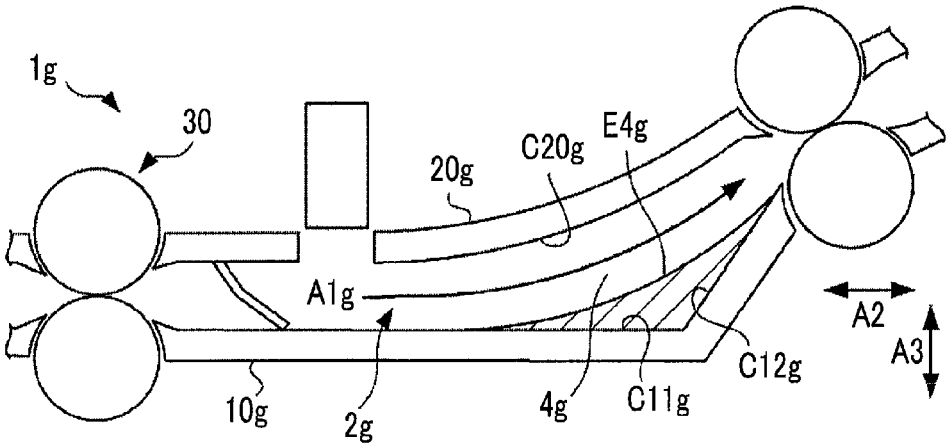
FIG. 11 is a view illustrating an example of another configuration of the transport device according to a modification example.

FIG. 11 is a view illustrating an example of the configuration of the transport device according to this modification example. This example illustrates a transport device 1*g*, in which the medium that is transported in a direction along the horizontal direction A2 by the first transport member 30 is gradually changed in direction to upward in the vertical direction A3 and is transported to an arc-drawing transport direction A1*g*. A second guiding member 20*g* has a curved surface C20*g* in the transport direction A1*g* and forms a transport path 2*g*.

A first guiding member 10*g* has flat surface-shaped surfaces C11*g* and C12*g* that are directed to a transport path 2*g* side, and the transport path 2*g* is formed by these surfaces. In addition, the surfaces C11*g* and C12*g* form an expansion space 4*g*. In FIG. 11, a widening part E4*g* of the expansion space 4*g* is illustrated by hatching. When the transport direction draws the arc, the transported medium is more likely to pass through an outer side than an inner side of the arc. The widening part is disposed on the outer side of the arc as illustrated in FIG. 11, and thus the slack part of the medium is more likely to pass through the widening part and the medium is less likely to be pressed back by the guiding member than when the widening part is disposed on the inner side of the arc, and the posture of the medium is stabilized at the processing position as in each of the exemplary embodiments described above.

[4-8] Category of Exemplary Embodiment of Invention

The exemplary embodiments of the invention may also be applied to an inspection device and an image reading apparatus that output a result of the reading by the reading device 60. In addition, the exemplary embodiments of the invention may also be applied to an image forming apparatus that ejects ink to the transported medium to form an image if the ejecting device which ejects ink to the medium is provided as the processing unit. Any of these devices is a transport device that performs processing on the medium at the processing position while transporting the medium, and it is preferable that the posture of the medium be stabilized at the processing position in any of the devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents

What is claimed is:

1. A transport device comprising:

a first transport member that transports a sheet-shaped medium in a transport direction;

a transport path that is formed by a first guiding member which is disposed on a downstream side of the first transport member in the transport direction and on a first surface side of the transported medium to guide the medium in the transport direction and a second guiding member which is disposed on a second surface side of the transported medium which is on a back side of the first surface to guide the medium in the transport direction, at least one of the first guiding member and the second guiding member including a widened part on a downstream side of a processing position and on an upstream side of a second transport member, wherein a widening for the widened part begins at location on the downstream side of the processing position;

a pressing member that presses the medium to the first guiding member;

a processing unit that performs a processing on the medium which is transported in the transport path on a further downstream side in the transport direction than the pressing member; and a second transport member that is disposed on the downstream side of the processing position where the processing unit performs the processing on the medium, and transports the medium, which is guided by the first guiding member and the second guiding member, in the transport direction.

2. The transport device according to claim 1, wherein the second transport member transports the guided medium such that a downstream side of the medium in the transport direction is directed toward the first guiding member side.

3. The transport device according to claim 2, wherein a first distance between a line segment that connects a first position where the first transport member comes into contact with the medium with a second position where the second transport member comes into contact with the medium and the first guiding member at a position where the medium is pressed to the first guiding member by the pressing member is shorter than a second distance between the line segment and the second guiding member at the position.

4. The transport device according to claim 2, wherein the widened part in the transport path is wider on the first guiding member side than on the second guiding member side.

5. The transport device according to claim 4, wherein a speed at which the second transport member transports the medium is slower than a speed at which the first transport member transports the medium.

6. The transport device according to claim 2, wherein a speed at which the second transport member transports the medium is slower than a speed at which the first transport member transports the medium.

7. The transport device according to claim 2, further comprising:

a second pressing member that is disposed on the downstream side of the processing position and on an upstream side of the widened part and presses the first surface of the medium to the first guiding member.

8. The transport device according to claim 1, wherein the second transport member includes a first rotating member and a second rotating member, and is arranged to be inclined with respect to the transport direction.

9. The transport device according to claim 8, wherein a first distance between a line segment that connects a first position where the first transport member comes into contact with the medium with a second position where the second transport member comes into contact with the medium and the first guiding member at a position where the medium is pressed to the first guiding member by the pressing member is shorter than a second distance between the line segment and the second guiding member at the position.

10. The transport device according to claim 8, wherein the widened part in the transport path is wider on the first guiding member side than on the second guiding member side.

11. The transport device according to claim 10, wherein a speed at which the second transport member transports the medium is slower than a speed at which the first transport member transports the medium.

12. The transport device according to claim 8, wherein a speed at which the second transport member transports the medium is slower than a speed at which the first transport member transports the medium.

13. The transport device according to claim 8, further comprising:

a second pressing member that is disposed on the downstream side of the processing position and on an upstream side of the widened part and presses the first surface of the medium to the first guiding member.

14. The transport device according to claim 1, wherein a first distance between a line segment that connects a first position where the first transport member comes into contact with the medium with a second position where the second transport member comes into contact with the medium and the first guiding member at a position where the medium is pressed to the first guiding member by the pressing member is shorter than a second distance between the line segment and the second guiding member at the position.

15. The transport device according to claim 14, wherein the widened part in the transport path is wider on the first guiding member side than on the second guiding member side.

16. The transport device according to claim 14, wherein a speed at which the second transport member transports the medium is slower than a speed at which the first transport member transports the medium.

17. The transport device according to claim 14, further comprising:

a second pressing member that is disposed on the downstream side of the processing position and on an upstream side of the widened part and presses the first surface of the medium to the first guiding member.

18. The transport device according to claim 1, wherein a speed at which the second transport member transports the medium is slower than a speed at which the first transport member transports the medium.

19. The transport device according to claim 1, further comprising:

a second pressing member that is disposed on the downstream side of the processing position and on an upstream side of the widened part and presses the first surface of the medium to the first guiding member.

20. The transport device according to claim 1, wherein the first guiding member or the second guiding member has a first surface and a second surface arranged on a further downstream side than the first surface, the first surface and the second surface form the widened part, and a first angle that is formed by the first surface and the transport direction is larger than a second angle that is formed by the second surface and the transport direction.

* * * * *